United States Patent [19]

Piotti, Jr.

[11] 4,371,983

[45] Feb. 8, 1983

[54] WEIGHT ATTACHMENT FOR BASEBALL GLOVE

[76] Inventor: Joseph J. Piotti, Jr., 1625 Logan Ave., Rear, Altoona, Pa. 16602

[21] Appl. No.: 221,914

[22] Filed: Dec. 31, 1980

[51] Int. Cl.[3] ..... A41D 13/08; A41D 19/00

[52] U.S. Cl. ..... 2/19; 2/160; 2/DIG. 6

[58] Field of Search ..... 2/19, 18, 161 A, 159, 2/160, 162, DIG. 6; 272/67, 119, 143; 273/26 C, 54 B

[56] References Cited

U.S. PATENT DOCUMENTS

| | | | |
|---|---|---|---|
| 952,556 | 3/1910 | Yeager et al. | 2/19 |
| 1,072,697 | 9/1913 | Cameron | 2/19 |
| 3,149,839 | 9/1964 | Materia | 2/161 A |
| 3,490,766 | 1/1970 | Gardner | 272/67 X |
| 3,588,105 | 6/1971 | Donohoe | 272/119 X |
| 4,247,097 | 1/1981 | Schwartz | 272/67 |
| 4,247,101 | 1/1981 | Gallmeyer | 272/119 X |

*Primary Examiner*—Richard J. Scanlan, Jr.
*Attorney, Agent, or Firm*—Harvey B. Jacobson

[57] ABSTRACT

A baseball fielder's glove containing a weight attached thereto. The weighted fielder's glove increases the strength, quickness and agility of a ball player's fielding hand by strengthening the wrist and hand through continual use. The weight is preferably rubber coated and secured to the wrist strap of the fielder's glove.

7 Claims, 4 Drawing Figures

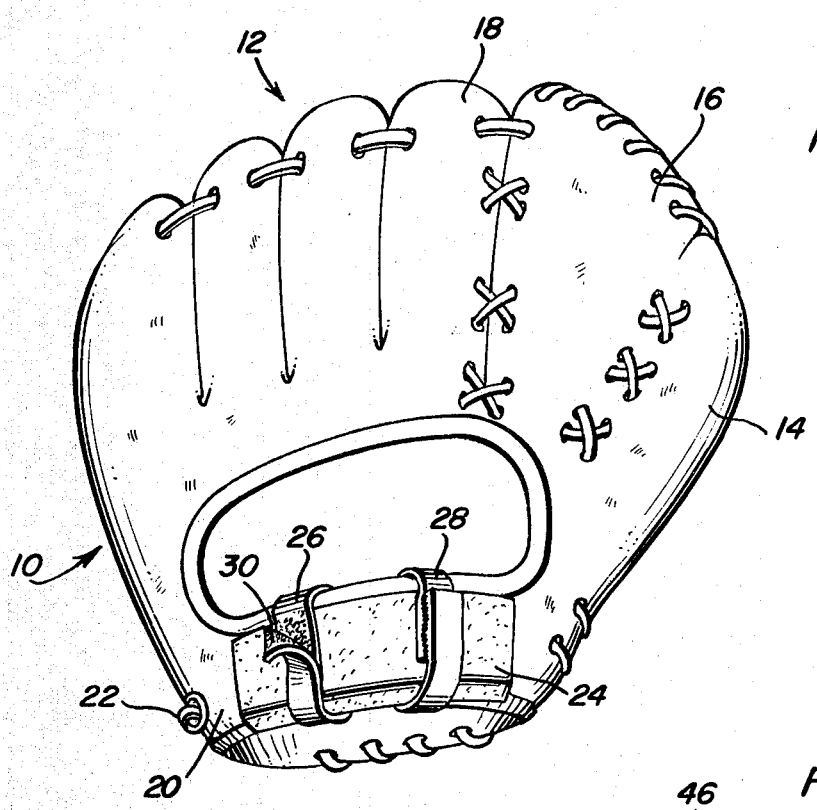
FIG. 1
FIG. 2
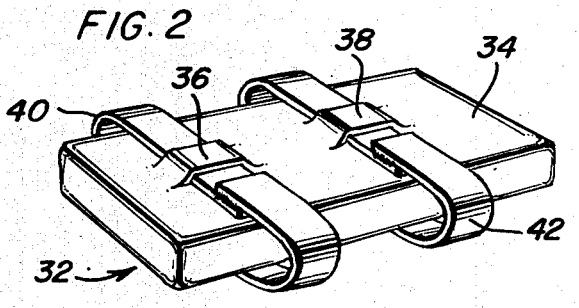
FIG. 3
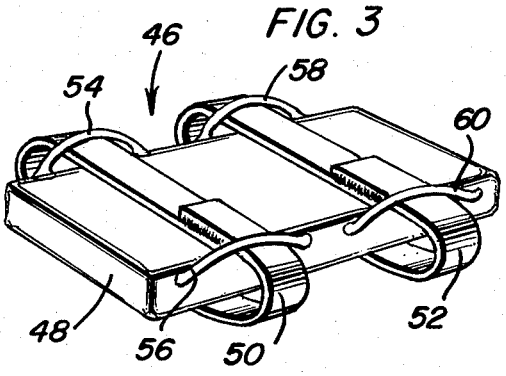
FIG. 4
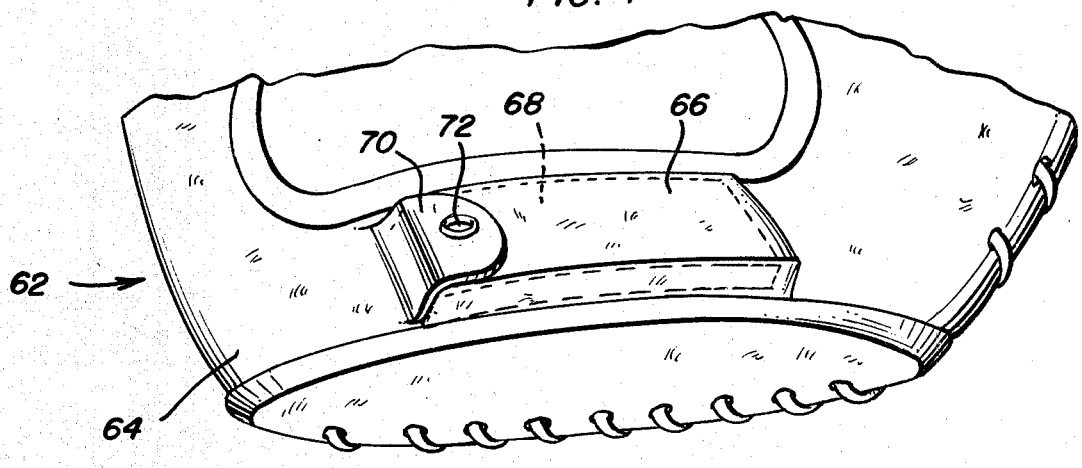

WEIGHT ATTACHMENT FOR BASEBALL GLOVE

BACKGROUND OF THE INVENTION

1. Field of the Invention

This invention relates to weighted gloves, and more particularly, to a baseball fielder's glove containing a weight attached to the wrist strap of the glove. One of the features which is important in good fielding play is the ability of the fielder to bring the glove down to the ground in order to pick up ground balls. Likewise, quickness of the glove hand to snag hard hit baseballs and to react to unusual bounces are also factors which determine good fielding. The above qualities for good fielding require a strong glove hand and wrist and, of course, many hours of practice. While the lifting of weights is one method of strengthening the muscles in the body including hands and wrists, it is not certain that such methods of increasing strength will increase the strength of those muscles required for good fielding.

The present invention relates to a baseball fielding glove with a weight attached thereto which strengthens the glove hand and wrist of the ball player during actual practice and further aids the ball player in maintaining the glove hand on the ground in the position for properly fielding balls hit on the ground.

2. Disclosure Statement

Several patents have been issued related to weighted gloves for use in various sports activities. In particular, U.S. Pat. No. 3,124,806, issued Mar. 17, 1964, to Campbell et al, discloses a golf training device in which a weight is placed within a pocket of the golf glove placed in the portion of the glove covering the back of the hand and wrist. U.S. Pat. No. 4,034,979, issued July 12, 1977, to Wester, discloses a weighted bowling glove in which the weight is positioned both above and below the metacarpel region of the bowler's free hand to foster correct bowling techniques by counterbalancing the one-sided shoulder pull of the bowling ball. Other patents disclosing additions to recreational sport gloves include U.S. Pat. No. 2,154,197, issued Apr. 11, 1939, to Callaway, which discloses a golf glove which is provided with elongated stays for restraining wrist motion; U.S. Pat. No. 4,137,572, issued Feb. 6, 1979, to Jansson et al, for a protective hockey glove including additional padding; U.S. Pat. No. 1,017,964, issued Feb. 20, 1912, to Fox, which discloses a baseball glove or mitt containing a pocket filled with a removable padding; and U.S. Pat. No. 4,042,975, issued Aug. 23, 1977, to Elliott, et al, which discloses a batting glove containing a pair of protective plates releasably secured to the backside of a glove. None of the above patents, however, discloses a baseball fielder's glove which is provided with a weight, and particularly to a weight which is attached to the wrist strap of the glove for increasing fielding skill.

SUMMARY OF THE INVENTION

This invention relates to a baseball fielder's glove which is provided with a weight attached to the wrist strap of the glove. The weight is preferably three to four inches long and about one-quarter inch thick. The weight is secured either by straps placed over the weight and the wrist strap of the glove or a pocket formed in the wrist strap in which the weight can be removably inserted. Other means of attaching the weight are contemplated and disclosed. The weight attached to the wrist strap of the fielding glove increases the strength, quickness and agility of the ball player's fielding hand through continual use during practice.

An object of the present invention is to increase the fielding skills of baseball players.

Another object of the invention is to provide a weighted baseball fielder's glove in which the weight attachment is removable and is designed to fit comfortably on the wrist strap of the glove.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view illustrating the back of a baseball fielder's glove and including a weight attached to the wrist strap thereof.

FIG. 2 is a perspective view illustrating one form of the weight and wrist strap attachment.

FIG. 3 is an alternative form of the weight and wrist strap attachment.

FIG. 4 is a fragmentary perspective view illustrating yet another form of the weight attachment in which the wrist strap is provided with a pocket in which the weight is inserted.

DETAILED DESCRIPTION OF THE INVENTION

In FIG. 1, a baseball fielding glove is generally indicated by reference numeral 10. Fielder's glove 10 includes finger area 12, thumb socket 14 and the conventional webbing 16 placed between the slot for the index finger 18 and thumb socket 14. Glove strap 20 maintains fielding glove 10 properly on the wrist of the user and can be tightened by pulling draw string 22.

Attached to wrist strap 20 is weight 24 fastened to wrist strap 20 by a pair of thin strap members 26 and 28 which encircle strap 20 and weight 24 and have placed at the opposite ends thereof a fastening means, such as a fiber hook fastener 30, commonly known as a "Velcro" fastener. Strap members 26 and 28 are wrapped tightly around wrist strap 20 and weight 24 to maintain weight 24 securely in place against wrist strap 20 during fielding practice.

An alternative weight attachment is illustrated in FIG. 2 in which a weight generally indicated by reference numeral 32 has a surface coating of rubber 34. Integral with rubber coating 34 is formed a pair of slots 36 and 38 which receive strap members 40 and 42, respectively. Placed on the ends of each strap member 40 and 42 is a "Velcro" fastener which enables the strap to be placed around weight 32, around strap 20 of fielder's glove 10 and in fastening engagement with the other end of the strap member to securely hold the weight against wrist strap 20.

FIG. 3 illustrates a similar, but slightly different, embodiment of weight attachment shown in FIG. 2 and is generally indicated by reference numeral 46. Weight attachment 46 comprises a rubber coated weight 48 and a pair of holding straps 50 and 52 which are restrained against the weight by two sets of restrainer strap pairs, 54, 56 and 58, 60, respectively. Restrainer straps 54, 56, 58 and 60 are formed from the rubber coating placed over the weight and are placed on opposite sides of rubber coated weight 48. Holding straps 50 and 52 are placed around rubber coated weight 48, around the wrist strap of a glove and secured to each other by conventional fastening means, such as "Velcro" fastening device.

FIG. 4 illustrates another possible structure for incorporating a weight onto the wrist strap of a fielder's glove. In FIG. 4, the fielder's glove is represented by reference numeral 62 which contains wrist strap 64. Formed integral with the material that forms wrist strap 64 or sewn thereon is pocket 66 containing therein weight 68. Pocket 66 can be closed by cover 70 which is fastened to the body of pocket 66 by means of closure means 72, such as a button, snap fastener, or the like. In this manner, weight 68 can be removed or inserted in pocket 66 depending on whether the user is in an actual game or is practicing.

While the embodiments of the invention illustrated in FIGS. 1 through 4 involve means which temporarily hold the weight on the wrist strap, it is also contemplated for the present invention that a wrist strap may have a weight sewn permanently in the wrist strap to strengthen the wrist and better the fielding abilities of a user during practice and during play in organized game conditions.

While the size of the weight attached to the wrist strap can vary, a length of approximately three to four inches and a thickness of about one-quarter inch is the size which fits nicely adjacent the wrist strap of conventional fielder's gloves. The amount of weight can vary widely depending upon the size of the glove and user's age. Preferably, the weight should be about from one to about five pounds, or even more, depending upon the user's preference. The weights can be formed from solid metal, solid plastics, or even hollow plastics filled with a fluid which allows the weight to be varied from time-to-time as the user gradually strengthens the wrist area.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A baseball fielder's glove useful during training to increase the strength, quickness and agility of a ball player's fielding hand through continued use, the baseball fielder's glove comprising a wrist strap included integrally with a back portion of said baseball fielder's glove for retaining the glove on the user's hand, a weight comprised of metal material, and fastener means securing the weight on the wrist strap, said fastener means including layer material at least partially encompassing the weight and the wrist strap.

2. The fielder's glove of claim 1 wherein said fastener means is a temporary fastening means which allow the weight to be attached and removed from the glove as desired by the user.

3. The invention according to claim 1 wherein said layer material is an elastomeric coating extending throughout a surface of the material.

4. The invention according to claim 3 wherein said layer material has the coating formed into a pair of restrainer slot means which receive strap members, and a set of strap members placed through the slots and around the wrist strap terminating at one end in a Velcro fastener which enables the strap members to be placed around the weight and in fastening engagement with a Velcro fastener at the other end of the strap member to securely hold the weight against the wrist strap.

5. The invention according to claim 1 wherein said layer material is a thin strap means encircling the wrist strap and the weight and having at opposite ends thereof a fastener element such as a fiber hook fastener commonly known as a Velcro fastener.

6. The invention according to claim 1 wherein said layer material is constructed integrally with the wrist strap as a pocket for containing said weight, a cover for the pocket, and closure means for the cover, so the weight can be removed from and inserted into the pocket.

7. The invention according to claim 1 wherein said fastener means includes a Velcro tape fastener formed of one kind of tape and of another kind of tape selectively consisting of hook tape or pile tape, the weight being covered by said layer material having at least a portion of said one kind of tape and the wrist strap being covered by said layer material having at least a portion of said other kind of tape.

* * * * *